US010906198B2

(12) United States Patent
Le Roux

(10) Patent No.: US 10,906,198 B2
(45) Date of Patent: Feb. 2, 2021

(54) INSTALLATION FOR CUTTING FOOD PRODUCTS EQUIPPED WITH MEANS FOR FILLING THE CHUTE

(71) Applicant: KAUFLER—SMO INTERNATIONAL, Loudeac (FR)

(72) Inventor: Stephane Le Roux, Louargat (FR)

(73) Assignee: KAUFLER—SMO INTERNATIONAL, Loudeac (FR)

( * ) Notice: Subject to any disclaimer, the term of this patent is extended or adjusted under 35 U.S.C. 154(b) by 0 days.

(21) Appl. No.: 16/245,044

(22) Filed: Jan. 10, 2019

(65) Prior Publication Data

US 2019/0217492 A1 Jul. 18, 2019

(30) Foreign Application Priority Data

Jan. 12, 2018 (FR) ..... 18 50255

(51) Int. Cl.
*B26D 1/08* (2006.01)
*B26D 7/06* (2006.01)
(Continued)

(52) U.S. Cl.
CPC ..... *B26D 1/08* (2013.01); *B26D 3/161* (2013.01); *B26D 7/0608* (2013.01);
(Continued)

(58) Field of Classification Search
CPC ..... B26D 1/08; B26D 2007/327; B26D 2210/06; B26D 3/161; B26D 3/167;
(Continued)

(56) References Cited

U.S. PATENT DOCUMENTS 3,433,278 A * 3/1969 Comstock ..... B26D 3/185 83/73
4,111,087 A * 9/1978 Pankratz ..... B26D 1/553 198/781.02
2011/0265621 A1* 11/2011 Schmidt ..... B26D 7/30 83/35

FOREIGN PATENT DOCUMENTS

EP 1854596 A1 11/2007
EP 1935590 A1 6/2008
FR 3047433 A1 8/2017

OTHER PUBLICATIONS

Preliminary Research Report and Written Opinion received for French Application No. 1850255, dated Sep. 11, 2018, 7 pages (1 page of French Translation Cover Sheet and 6 pages of original document).

* cited by examiner

*Primary Examiner* — Stephen Choi
(74) *Attorney, Agent, or Firm* — Womble Bond Dickinson (US) LLP

(57) ABSTRACT

An installation (I) for cutting food products in the form of elongated loaves (P). The installation includes at least one assembly (E) with at least one chute or magazine for receiving a loaf (P). The chute has the form of an elongated compartment configured to receive the loaf (P) via its open upper end, with the possibility of sliding so as to direct it towards and beyond its open lower end. A generally horizontal tray is arranged at a distance from the lower end of the chute with a cutting blade arranged near the tray. A displacement mechanism alternatively guides the lower end so that said blade interacts the loaf and executes its cutting. Also included is a storage unit (S) and a mechanised and/or automated unit for picking-off at least one loaf (P) from the
(Continued)

storage unit (S) and for transferring and loading it in the chute.

9 Claims, 8 Drawing Sheets

(51) Int. Cl.
*B26D 3/16* (2006.01)
*B26D 7/32* (2006.01)

(52) U.S. Cl.
CPC ..... *B26D 7/0641* (2013.01); *B26D 7/0683* (2013.01); *B26D 7/325* (2013.01); *B26D 3/167* (2013.01); *B26D 2007/327* (2013.01); *B26D 2210/06* (2013.01)

(58) Field of Classification Search
CPC .. B26D 7/0608; B26D 7/0641; B26D 7/0683; B26D 7/325
See application file for complete search history.

INSTALLATION FOR CUTTING FOOD PRODUCTS EQUIPPED WITH MEANS FOR FILLING THE CHUTE

FIELD OF THE INVENTION

The present invention relates to an installation for cutting food products which are in the form of elongated loaves, otherwise called bars.

These can be meat products such as sausage, ham, bacon, or even cheese or products of vegetable origin (pineapple slices, for example).

Throughout the present application, "elongated loaf" means not only a monolithic loaf, that is, constituted by one and the same piece of food product, but also "stacking" of several blocks of food products which have no real mechanical cohesion between them, the whole overall having the appearance of a loaf.

TECHNOLOGICAL BACKGROUND OF THE INVENTION

Document FR-A-3047433, in the name of the present applicant, describes an installation of this type, which makes use of chutes (magazines) into which loaves ready for cutting are introduced.

More generally, as long as several magazines arranged side by side are provided, this type of device simultaneously cuts several portions of food product in an orderly manner at a determined place such that these portions are distributed into receptacles which pass by under the device, conveyed for example by a conveyor belt, or are deposited directly onto the conveyor passing by underneath. In other applications, portions are distributed onto pizzas or slices of loaf (constituted by sandwiches, cordons bleus, etc.) which are moved by a conveyor.

Also, in a transformation method of food products portions of meat may be required to be deposited in orderly rows on a conveyor designed to transfer the products to a processing station, for example for deep-freezing, cooking or cooling.

Similarly, in the agri-foodstuff industry it is common to use this type of "slicer" for assembly operations of different slices to make up the final product. Therefore, open-faced sandwiches or small sandwiches known as "buns" are constituted by several elements such as bread, ham and cheese. These operations are undertaken on the fly by detection of the product, cutting and deposit of the following element onto a support such as a receptacle passing by below the apparatus or directly onto a slice of loaf.

Another example is the situation where a large number of slices of meat is cut, for example bacon, which are forwarded by a conveyor to an oven.

Mainly for reasons of output increase, this kind of device has been multiplied so as to increase the number of lines working in unison.

But this requires the simultaneous placing of several loaves of food products into the chutes which are positioned vertically and by reciprocal movement for the purpose of cutting slices. In fact, as far as possible the aim is for the slicing to occur continuously, which needs continual replenishing of the chutes.

For reasons related to bulk, the open upper end of the chutes via which the loaf to be cut is introduced is arranged at a height such that operators have access to it via at least one platform accessed by stairs.

Due to the many return trips between the ground on which the pallets of loaves to be cut are assembled and stored and the loading level in the chutes, there is a high risk of falls by operators on the platform stairs.

Also, the individual weight of each loaf of product can be between 10 and 20 kg, obliging operators to carry loaves horizontally in their arms to the unit or up to two high, between the ground and the upper level of the loading ramp, using the stairs.

Loading into the chutes requires rapid lifting and rotation of each bar, synchronous with the seesaw or linear movement of the chute to be loaded. These complicated, repetitive and rapid movements especially cause risk of injury, particularly for backs.

Also, the technology of these machines requires an even loading level between the different chutes. For obvious reasons this cannot be adhered to where it is impossible for an operator to quickly reload several chutes at the same time. Accordingly, this quickly results in a difference in quality in the slicing and deposit of sliced products between the different lines.

Documents EP 1935590 and EP 1854596 contribute additional prior art.

The aim of the present invention is to eliminate these disadvantages and it aims in particular to improve the installation described in the above document FR-A-3047433.

SUMMARY OF THE INVENTION

Therefore, the present invention relates to an installation for cutting food products which are in the form of elongated loaves, and which comprises:

- at least one assembly comprising at least one chute or magazine for receiving a loaf of food product, this chute having the form of an elongated compartment, generally directed from top to bottom, and configured to receive said loaf via its open upper end, with the possibility of sliding so as to direct it towards and beyond its open lower end under the effect of its own weight;
- a generally horizontal tray, arranged at a distance from the lower end of said chute, and a cutting blade arranged near this tray;
- displacement means of said assembly configured to alternatively guide said lower end near said tray so that said blade interacts with said loaf and executes its cutting, characterized in that it comprises on the one hand a storage unit of food loaves and on the other hand mechanised and/or automated means for picking-off at least one loaf from said storage unit and for transferring and loading it in said chute, via its open upper end and in that:

- said storage unit comprises one or more superposed trays forming a stack;
- it comprises means configured so that the highest tray on which loaves are present always occupies a constant level;
- it comprises at least one thrust member such as a jack configured to discharge said loaves present on the highest tray;
- as well as a receptacle mobile between a loading position in which it receives at least one loaf discharged by said at least one thrust member, and a transfer position in which said receptacle is positioned opposite said chute, in the immediate vicinity of its open upper end.

Thanks to all these characteristics, operators no longer have to move around and carry heavy loads, and this radically lowers the risk of falling and injury. They can consequently concentrate on supplying the storage unit, monitoring proper overall operation of the installation and rapidly intervening where needed.

Similarly, putting these devices in place leads to a substantial rise in the quality of the slicing and depositing of the slices.

According to other non-limiting and advantageous characteristics of the invention:

- it comprises discharge means of said at least one loaf which act when said receptacle is in said transfer position, these means ensuring the displacement of said loaf in the direction of the open upper end of said chute;
- said chute comprises a flared upper end whereof one side extends approximately horizontally and said discharge means operate according to generally horizontal translation;
- said discharge means operate according to generally horizontal translation, combined with a tilting movement.
- said receptacle rests on and is shifted along two parallel guide paths;
- it is provided with a raised platform which adjoins said at least one chute and which is accessible to operators so as to have access to said at least one chute, from above the latter;
- said platform is provided with two parallel railings, the upper bar of each of the latter constituting one of the two guide paths;
- it comprises one or more assemblies of chutes arranged on either side of said platform, said discharge means acting selectively and on demand in the direction of one or the other of said two assemblies;
- said at least one chute is provided with at least one detector configured to selectively trigger execution of the mechanised and/or automated means for picking off at least one loaf in said storage unit and then for transferring and loading it in said chute.

BRIEF DESCRIPTION OF DRAWINGS

Other characteristics and advantages of the invention will emerge from the following description of some preferred embodiments of the invention. This description, given in a non-limiting manner, is made in reference to the appended drawings, in which.

DETAILED DESCRIPTION OF THE INVENTION

Figure 1:
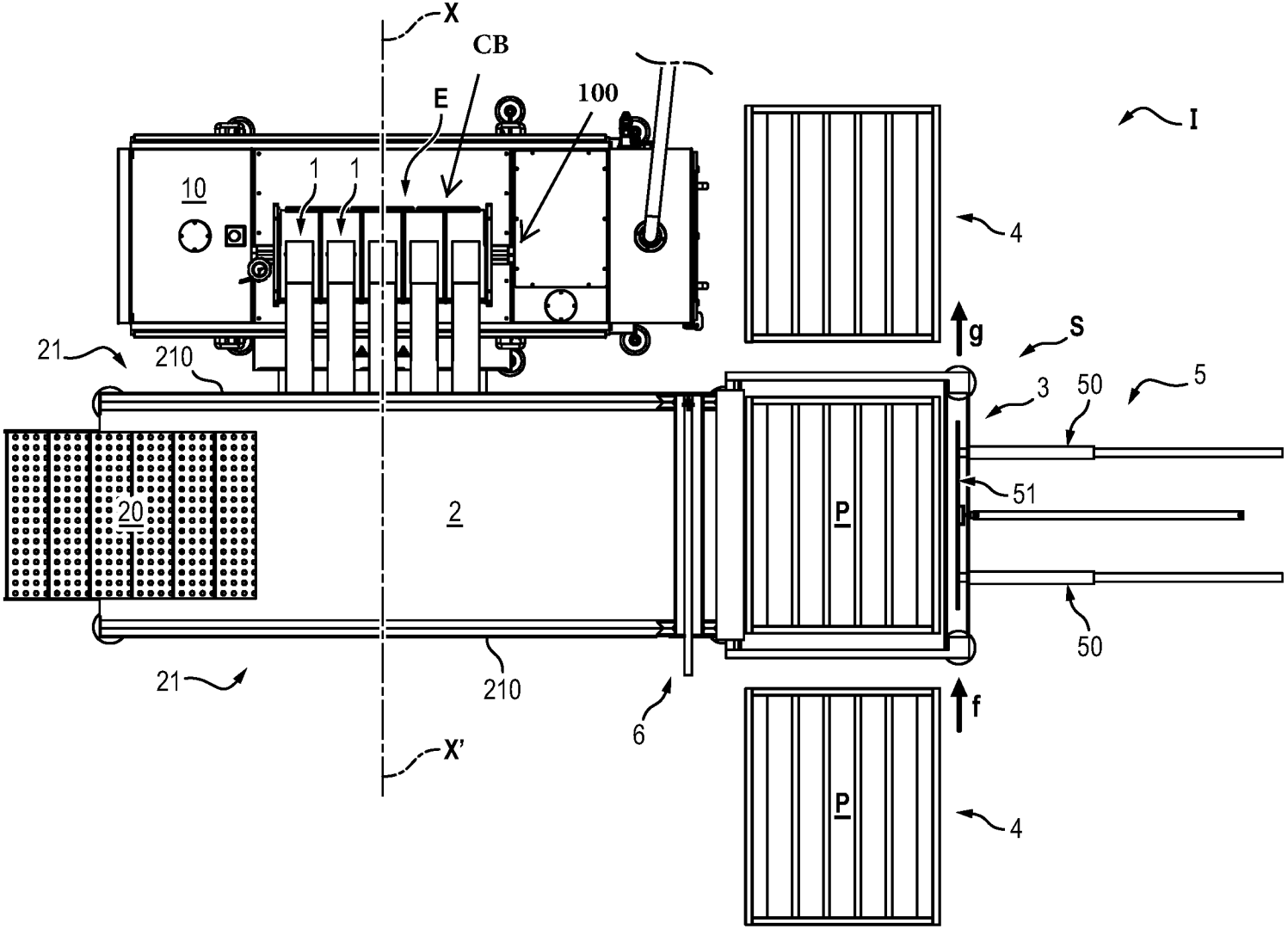
FIG. 1 is a plan view of a first embodiment of a cutting installation according to the invention.

In reference to the appended FIGS. 1 to 4, these relate to an installation I for cutting food products which are in the form of elongated loaves P, an installation which comprises an assembly E comprising a series of chutes 1 (also called magazine for receiving a loaf of food product).

In the example shown here, there are five of these chutes 1. Of course, this number can vary, for example fewer or more. This assembly therefore has the particular feature of being composed of individual chutes which are juxtaposed such that said assembly has an optimised overall width which is substantially equal to that of an endless mobile conveyor, not shown in the above figures, but whereof the longitudinal axis X-X' appears in FIG. 1.

This assembly E of chutes 1 is mounted on a solid frame 10 of known type such that the upper opening 11 of each of them is largely raised relative to the ground.

Although this is not shown in the above figures, the frame 10 integrates displacement means 100 which allow the chutes 1 to be shifted according to alternating movement, either strictly linear or seesaw, so as to periodically approach their lower end, and accordingly the lower end of a loaf P of food product engaged in each of the chutes 1 near a cutting blade CB arranged in the region of a horizontal tray which extends below the chutes.

Reference can be made if needed to document FR 3 047 433 which has been cited in the introduction of the present application for more explanation on the structure and operation of an example of such an assembly.

The alternating movement mentioned above reproduced a certain number of times cuts each of the loaves into a large number of slices of food product. These slices drop either directly onto the abovementioned conveyor or into containers previously deposited on the conveyor, or directly onto food preparations such as pizzas, moved along behind each other by said conveyor.

Experience has shown that depositing these slices is carried out very regularly and evenly provided that around a third of the loaf P is still present in each chute. In these conditions, it is understood that it is preferable, or even imperative, to be prepared to introduce a fresh loaf P into each chute once only one third of the initial loaf remains in each chute. And this handling must be repeated for each chute, in minimal time, so as to obtain uniform cuts independently of the chutes.

Advantageously, detecting the presence of only a third of a loaf remaining in the chute can be done by at least one detector D.

In practice, introducing a loaf P into a chute 1, carried out while the installation I is operating, is done during a particular phase of the alternating movement of the chute, specifically the phase in which its open upper end is closest to the operator, to ensure work comfort.

In the embodiment shown here, the installation I comprises a platform 2 accessed by stairs 20 and which allows operators to have access to the upper opening 11 of the chutes 1 from the top of the latter for easy introduction of the loaves P.

The platform 2 extends parallel to the frame 10 of the assembly E, that is, according to a direction generally perpendicular to the above axis X-X'. Also and as shown in the figures, the platform 2 adjoins the assembly E so that one of its longitudinal edges is close to the upper opening 11 of the chutes 1.

Essentially for safety reasons, the platform 2 is provided with two railings 21 whereof the horizontal upper bar is referenced 210. This lets operators present on the platform bend over, quite particularly above the assembly E, without concern for their safety.

Also and as will be explained later in the description, these upper bars 210 have an additional function, specifically that they constitute guide paths for a receptacle for receiving and transferring food loaves.

Also, the installation shown in the above figures has dynamic vertical storage means S of loaves intended to supply the chutes 1 described above.

These dynamic vertical storage means are arranged at the end of the platform 2 which is opposite the stairs 20.

They comprise a storage and elevation device at constant level 3 which essentially comprises a parallelepiped frame 30 which is latticed and of vertical orientation and is configured to selectively receive a storage sled 4 in which arrays of loaves P of food products are placed previously on superposed trays 40.

Therefore, a sled 4 on which loaves P are already placed can be shifted manually by an operator or automatically by pusher means of an adapted device, inside the frame 30 via a lateral opening, as shown by arrow fin FIG. 1.

Also, the frame 30 integrates pusher means 300 which keep the highest tray 40 of the sled still filled with loaves P at a constant level, that is, at the same height.

In other terms, whenever a sled 4, all trays 40 of which are filled with loaves P, has its top tray offload loaves P which it was holding, the device 3 is actuated so that the tray is immediately below or positioned at the same height as the preceding tray, and so on.

This level-raising always at a constant height is triggered for example via a sensor which detects the absence of loaves on a determined tray and controls the raising of the sled so that the filled tray arranged immediately below is guided to an adequate level. In this case, this "constant" level corresponds substantially to that of the upper face of the bars 210 of the railings 21. The raising operation is performed for example by a chain conveying and raising system or any other device ensuring the same function.

When a sled 4 is empty, that is, when all these trays 40 have offloaded their loaves P, this sled is extracted from the frame 30 via its opposite end, as shown by arrow g of FIG. 1.

As is particularly apparent in FIG. 1, the device 3 also integrates picking-off means 5 of at least one loaf P present at the level of the top tray 40 of the sled.

For this purpose, the above frame 30 is equipped here with pusher means 5 comprising a pair of parallel and horizontal jacks 50. A common pusher 51, fixed to the free end of the rod of jacks 5 is oriented parallel to the loaves P in place on the sled 4.

The means 5 extend at a height such that when the rod of the jacks is in an extended position, the pusher 51 shifts the loaves P into place on the highest tray 40.

Of course, actuating these jacks is done on command only, that is, when the chutes 1 need to be replenished with loaves P. This actuation is preferably controlled automatically as soon as the sensor mentioned above has detected the presence of only a third of a loaf in the relevant chute.

On specific command, these jacks are controlled so that the plate 51 is shifted towards the interior of the device 3 and interacts, that is, pushes the closest loaf P present on the highest tray of the device 3 so as to shift either one or all these loaves in the direction of the platform 2.

Still in terms of this particular embodiment, the installation also comprises transfer means of loaves towards one or the other of the above chutes 1.

Figure 4:
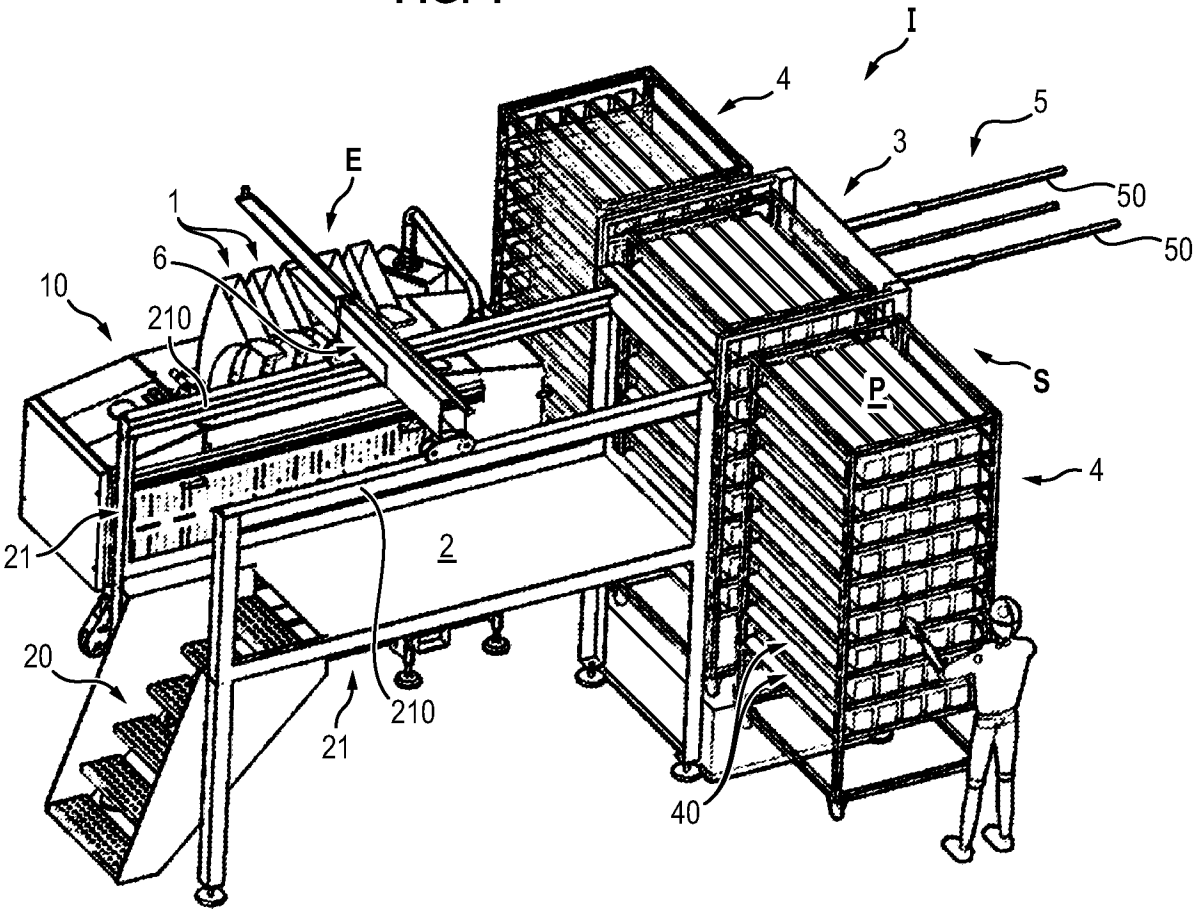

These transfer means consist of a receptacle 6, more particularly evident in FIG. 4, which is shifted selectively along the guide paths constituted by the upper face of the bars 210 of the railings 21.

The receptacle is also shown in FIGS. 1 to 3, 5 and 6. It is shown highly schematically, only so that its function can be understood.

This receptacle 6 has an elongated shape and extends horizontally and parallel to the above conveyor. Therefore it is supported on the upper face of the bars 210 of the railings 21 by rollers or wheels 60 and is controlled by self-propelled means not shown here. It is open to the side and towards the top so that it can receive at least one loaf P which previously has been discharged from a tray 4 by the pusher 51. This receptacle is preferably slightly hollow to receive and immobilise said loaf P.

Figure 2:
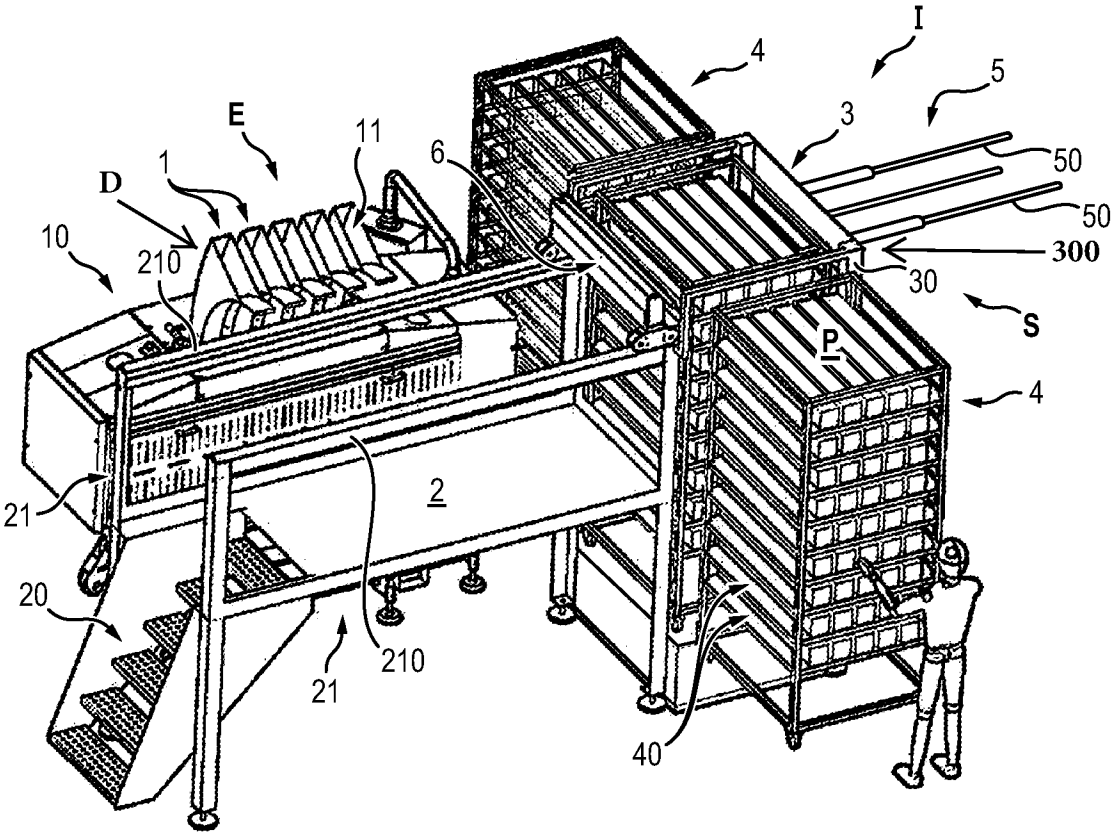
FIG. 2 is a perspective view of the installation of FIG. 1.
Figure 3:
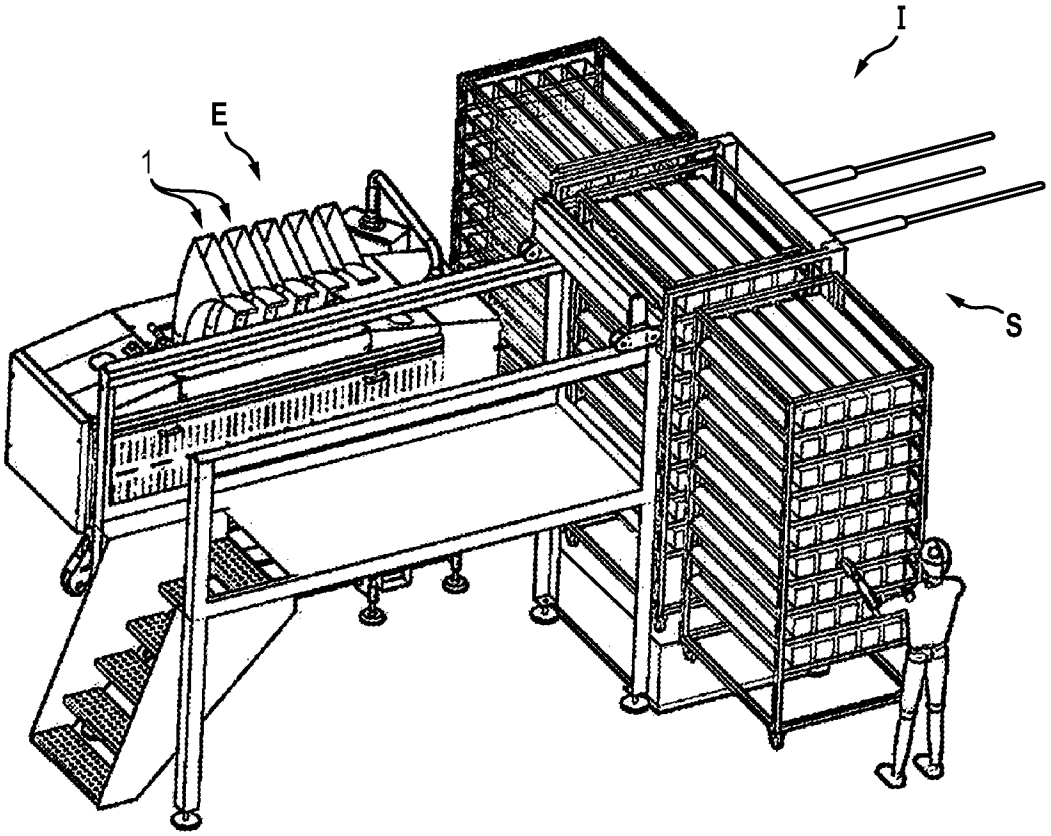
FIGS. 3 and 4 are views similar to FIG. 2, more specifically intended to illustrate different steps of transfer of food loaves to slicing chutes.

In these conditions, this receptacle 6 is positioned in a standby, non-operational position at the end of the platform 2, closest to the device 3, as shown in FIGS. 1 and 2.

The installation comprises control means of this receptacle, which are designed to move it automatically on a path just enough for it to be positioned opposite the chute 1 to be supplied with loaf P. Therefore, in light of the situation of FIG. 4, this receptacle has been shifted to opposite the third chute 1, ready to introduce the loaf P it is transporting.

To allow this introduction, the receptacle 6 is equipped with discharge means 7 of the loaf P. These means comprise a jack 70 arranged horizontally and correctly above the receptacle and which is coupled to a pallet 71 arranged at the end of an actuation rod 72, with activation of said jack 70 presenting by linear displacement of the pallet 71 in the direction of the associated chute 1.

Figure 5:
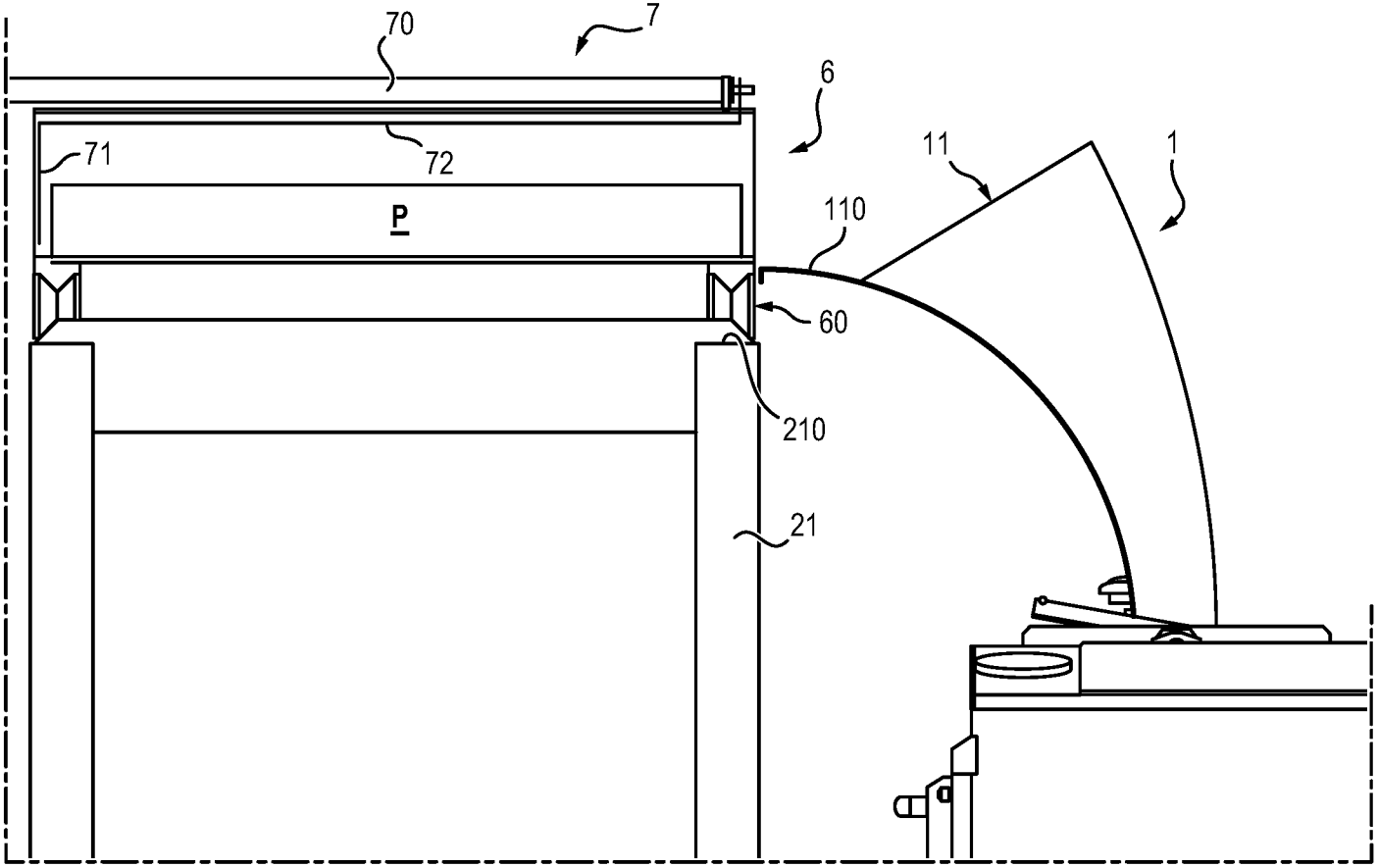
FIGS. 5 and 6 are diagrams of a specific part of the installation of the preceding figures, intended to show how the transfer of a loaf of food product towards the chute with which it is associated works.
Figure 6:
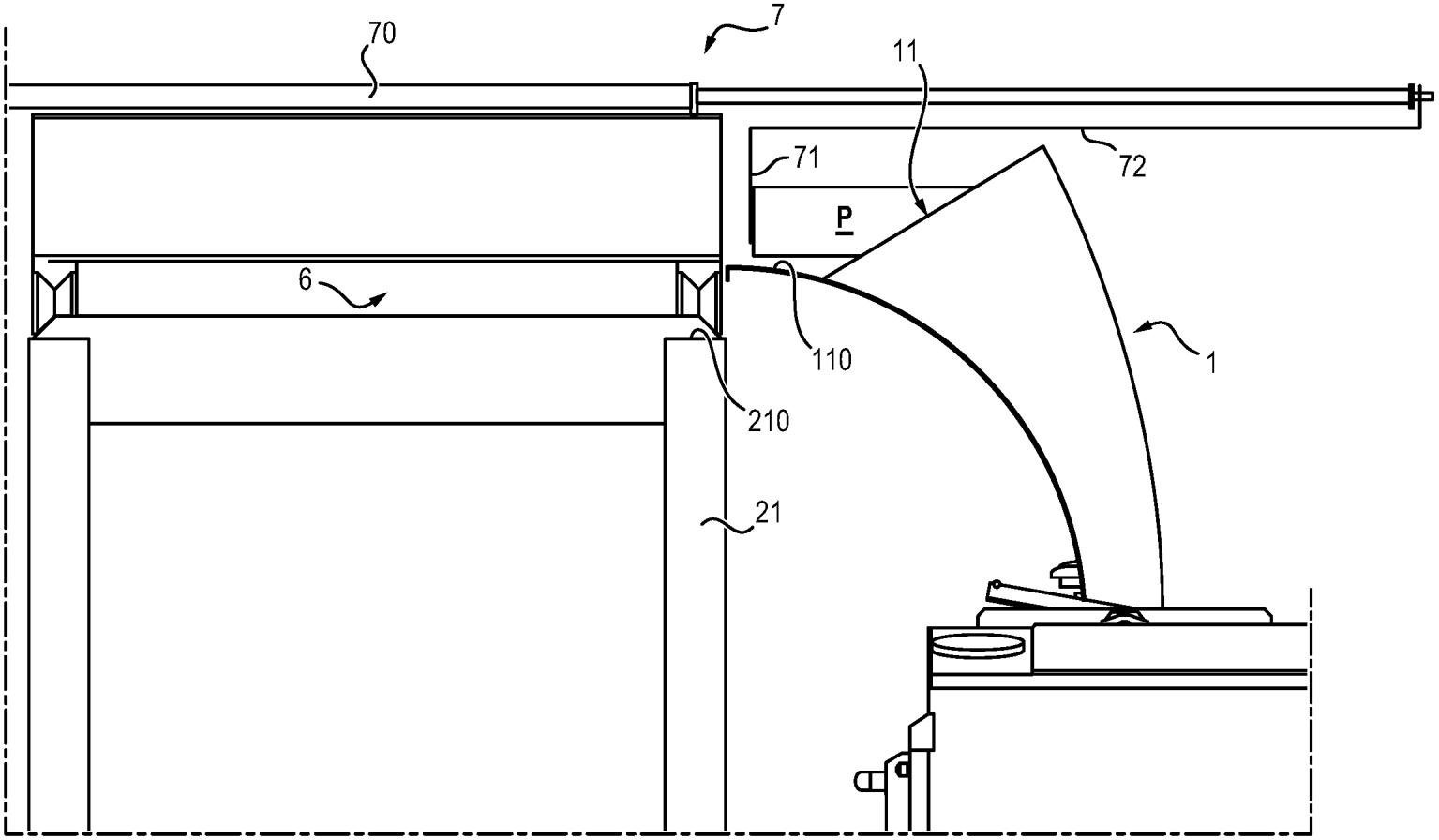

The move is made from the non-active position of FIG. 5 to the active position of FIG. 6.

In the installation I presented here, even though they are generally vertical in orientation, the chutes 1 have an upper opening 11 widely flared and oriented towards the receptacle, with a rim 110 directed almost at the horizontal.

In these conditions, moving the above pallet 71 via the jack 70 makes it possible and easy to shift the loaf P to direct it directly into the opening 11 of the chute, as shown in FIG. 6, without risk of incorrect operation. Next, the loaf P orients in the chute 1 on its own initiative, due to its capacity to deform and to the shape of the chute.

Assuming that the chutes 1 are not flared at the top, it can be more delicate to operate their transfer to these chutes. In another situation, the attempt can be made to quite simply introduce the loaves P into the chutes 1, according to an orientation as vertical as possible. It is the situation shown in FIGS. 7 and 8 in which the receptacle 6 assumes an angled orientation when it is positioned opposite a chute to be supplied.

To do this, means not shown such as a connecting rod or a cam are associated with the receptacle 6 and allow this receptacle to be positioned tilted, by lifting of its end opposite the chute 1 to be supplied.

Figure 7:
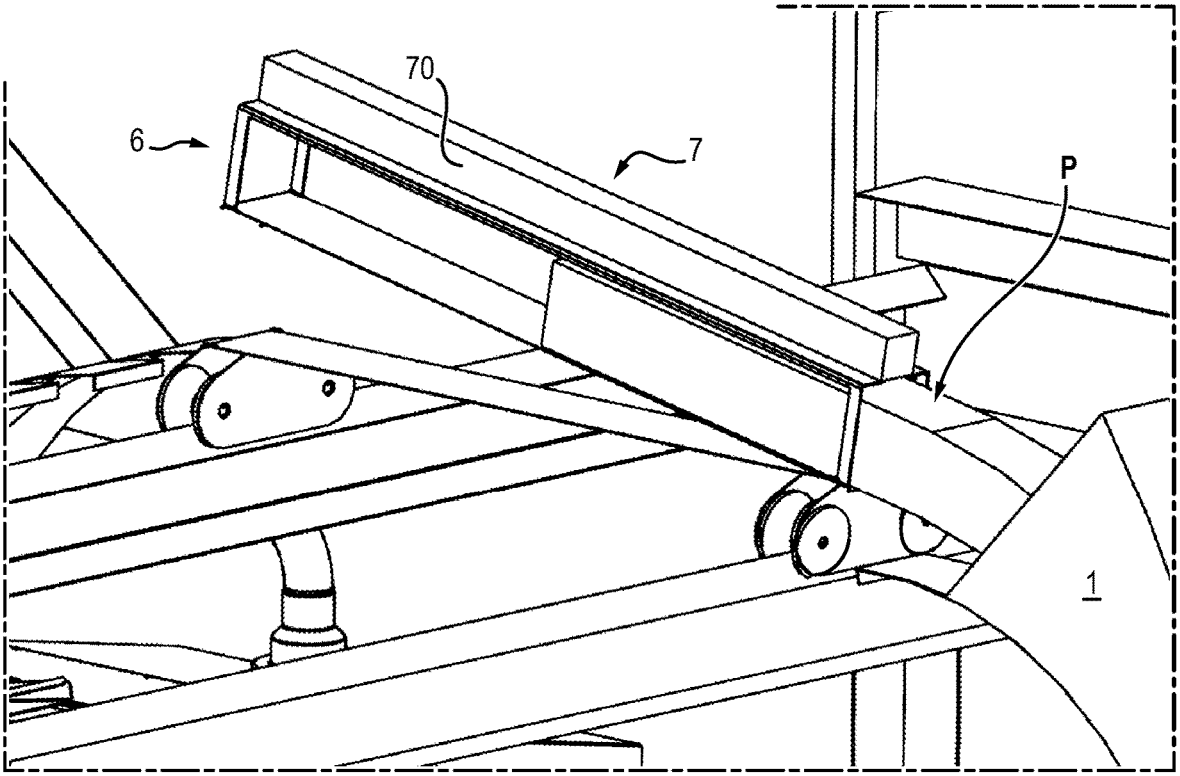
FIGS. 7 and 8 are also diagrams in perspective illustrating a variant embodiment of pusher means shown in FIGS. 5 and 6.
Figure 8:
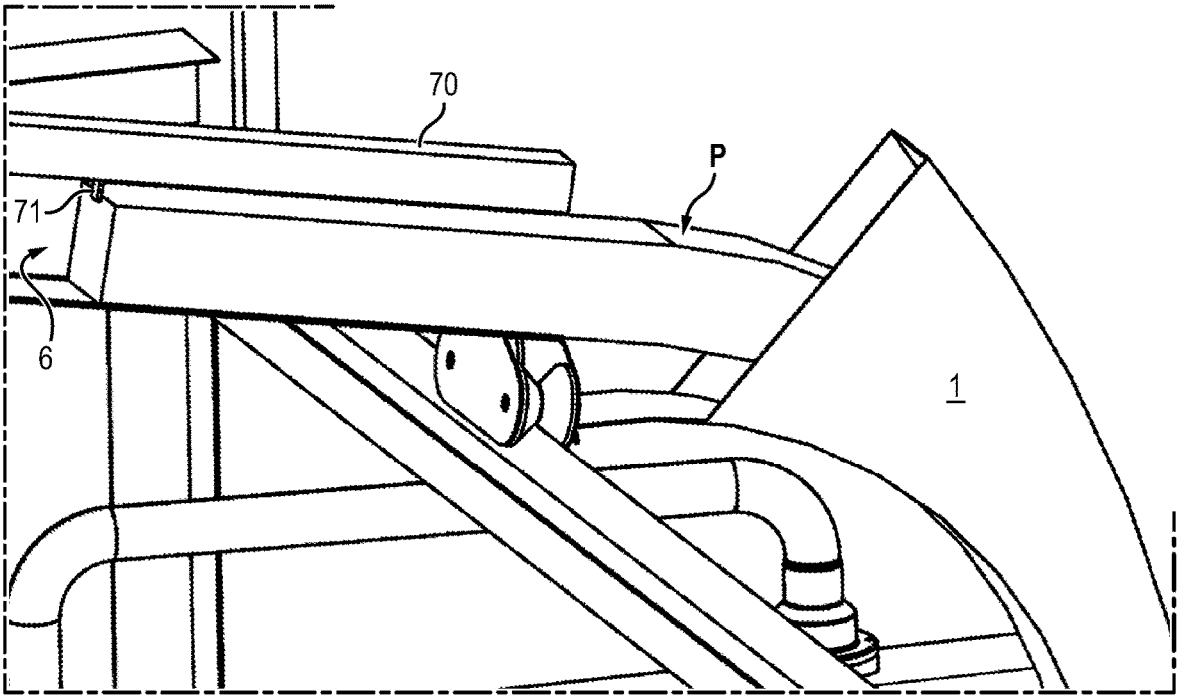

In this position, illustrated in FIGS. 7 and 8, the "work" of the pallet 71 of the jack 70 is made easier by the fact that by its weight the loaf P tends to slide naturally along the receptacle and return to the chute.

By way of the invention it is possible to provide all chutes in record time so that the quality and evenness of slicing the loaves is in no way affected.

The operation of the present installation is for example managed automatically via a robot.

Although this is not shown in the figures, it might be possible to deal with an installation I whereof the platform 2 comprises on each of its two sides an assembly E such as that specified, the receptacle 6 being configured to shift the loaves P either in the direction of one assembly or in the direction of the opposite assembly, as needed.

Figure 9:
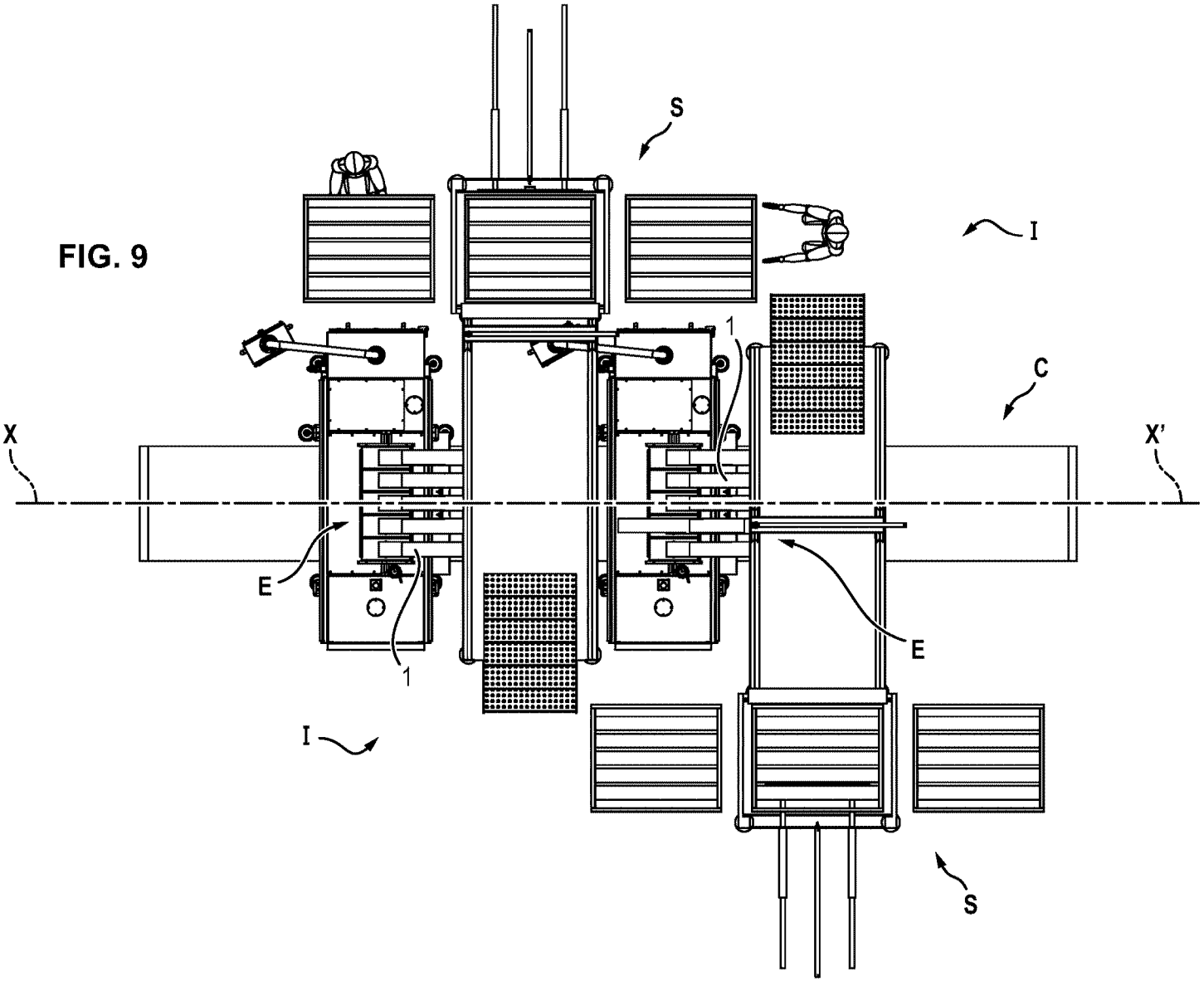
FIG. 9 is a plan view of an installation on a larger scale which is in fact constituted by two installations such as that of FIG. 1, arranged head to tail.

Finally, as shown schematically in FIG. 9, on the same site it is possible to put in place at least two installations I such as that of FIG. 1, as long as the latter is positioned head to tail.

One and the same conveyor C passes through these two adjacent installations, for example for cutting and depositing different food products.

The invention claimed is:

1. Installation for cutting food products which are in the form of elongated loaves and which comprises:

at least one assembly comprising at least one chute or magazine for receiving a loaf of food product, this chute having the form of an elongated compartment, generally directed from top to bottom, and configured to receive said loaf via the open upper end of said chute, and to direct said loaf towards and beyond the open lower end of said chute under the effect of its own weight;

a generally horizontal tray, arranged at a distance from the open lower end of said chute, and a cutting blade arranged near this tray;

displacement means of said assembly configured to alternatively guide said open lower end near said tray so that said blade interacts with said loaf and executes the cutting of said loaf, wherein said installation comprises on the one hand a storage unit of food loaves and on the other hand mechanised and/or automated means for picking-off at least one loaf from said storage unit and for transferring and loading said loaf in said chute, via the open upper end thereof and in that:

said storage unit comprises one or more superposed trays forming a stack, for receiving a plurality of loaves;

said installation comprises means configured so that the highest tray of said stack on which loaves are present always occupies a constant level;

said installation comprises at least one thrust member configured to discharge said loaves present on the highest tray of said stack;

as well as a receptacle mobile between a loading position in which said receptable receives at least one loaf discharged by said at least one thrust member, and a transfer position in which said receptacle is positioned opposite said chute, in the immediate vicinity of the open upper end thereof.

2. The installation according to claim 1, wherein it comprises discharge means of said at least one loaf which act when said receptacle is in said transfer position, these means ensuring displacement of said loaf in the direction of the open upper end of said chute.

3. The installation according to claim 2, wherein said chute comprises a flared upper end whereof one side extends approximately horizontally and in that said discharge means operate according to generally horizontal translation.

4. The installation according to claim 2, wherein said discharge means operate according to generally horizontal translation, combined with a tilting movement.

5. The installation according to claim 1, wherein said receptacle rests on and is shifted along two parallel guide paths.

6. The installation according to claim 5, wherein said installation is provided with a raised platform which adjoins said at least one chute and which is accessible to operators so as to have access to said at least one chute, from above of the open upper end thereof.

7. The installation according to claim 6, wherein said platform (2) is provided with two parallel railings, the upper bar of each of said railings constituting one of the two guide paths.

8. The installation according to claim 5, wherein said installation comprises one or more assemblies of chutes arranged on either side of said platform, said at least one thrust member acting selectively and on demand in the direction of one or the other of said two assemblies.

9. The installation according to claim 1, wherein said at least one chute is provided with at least one detector configured to selectively trigger execution of the mechanised and/or automated means, for picking off at least one loaf in said storage unit and then for transferring and loading said loaf in said chute.

* * * * *